US008833288B2

(12) United States Patent
Bertelsen

(10) Patent No.: US 8,833,288 B2
(45) Date of Patent: Sep. 16, 2014

(54) UNMANNED UNDERWATER VEHICLE AND METHOD FOR RECOVERING SUCH VEHICLE

(75) Inventor: Allan Bertelsen, Frederiksberg (DK)

(73) Assignee: Atlas Elektronik GmbH, Bremen (DE)

( * ) Notice: Subject to any disclaimer, the term of this patent is extended or adjusted under 35 U.S.C. 154(b) by 248 days.

(21) Appl. No.: 13/289,162

(22) Filed: Nov. 4, 2011

(65) Prior Publication Data

US 2012/0118217 A1 May 17, 2012

(30) Foreign Application Priority Data

Nov. 11, 2010 (EP) ..... 10190887

(51) Int. Cl.
*B63G 8/24* (2006.01)
*B63G 8/00* (2006.01)
*B63B 27/36* (2006.01)

(52) U.S. Cl.
CPC ..... *B63G 8/001* (2013.01); *B63B 27/36* (2013.01)
USPC ..... 114/326; 114/312

(58) Field of Classification Search
CPC ..... B63G 8/41; B63G 8/00; B63C 7/26; B63B 22/003; B63B 2205/08; B63B 2702/02; B63B 45/04
USPC ..... 114/326, 312, 313, 315, 316, 317, 321, 114/322, 330, 331, 337, 338
See application file for complete search history.

(56) References Cited

U.S. PATENT DOCUMENTS

| | | | | |
|---|---|---|---|---|
| 2,682,245 | A * | 6/1954 | Pinch | 114/326 |
| 3,175,525 | A * | 3/1965 | De Vries | 114/20.1 |
| 3,367,297 | A * | 2/1968 | Berger | 114/326 |
| 4,919,065 | A * | 4/1990 | Murray et al. | 114/312 |
| 5,377,165 | A | 12/1994 | LaPointe et al. | |
| 6,261,142 | B1 | 7/2001 | Fiotakis | |
| 7,028,627 | B2 * | 4/2006 | Bouchaud et al. | 114/51 |
| 7,083,487 | B2 * | 8/2006 | Weinel | 441/88 |
| 7,814,856 | B1 | 10/2010 | Smith et al. | |
| 2008/0029015 | A1 | 2/2008 | Amidon | |
| 2009/0107388 | A1 * | 4/2009 | Crowell et al. | 114/336 |

FOREIGN PATENT DOCUMENTS

| | | | |
|---|---|---|---|
| EP | 1125838 | A1 | 8/2001 |
| JP | 62234794 | A | 10/1987 |

* cited by examiner

*Primary Examiner* — Stephen Avila
*Assistant Examiner* — Anthony Wiest
(74) *Attorney, Agent, or Firm* — Fitch, Even, Tabin & Flannery LLP

(57) ABSTRACT

An unmanned underwater vehicle and a method for recovering an unmanned underwater vehicle. The unmanned underwater vehicle (1) is recovered by releasing a recovery buoy (21), which is connected to the vehicle (1) by a recovery line (22), recovering the recovery buoy (21) from the surface, attaching the recovery line (22) to a recovery system and lifting the vehicle (1) by the recovery system and the recovery line (22). To provide a safe recovery of the unmanned underwater vehicle under most weather condition, the vehicle (1) is submerged after releasing the recovery buoy (21) by reducing the buoyancy of the vehicle (1) and providing negative net-buoyancy (29).

15 Claims, 2 Drawing Sheets

UNMANNED UNDERWATER VEHICLE AND METHOD FOR RECOVERING SUCH VEHICLE

CROSS-REFERENCE TO RELATED APPLICATION

The present application claims the priority of European patent Application No. 10190887.9, filed Nov. 11, 2010, the subject matter of which, in its entirety, is incorporated herein by reference.

BACKGROUND OF THE INVENTION

The invention relates to an unmanned underwater vehicle and a method for recovering an unmanned underwater vehicle.

Unmanned underwater vehicles may be broadly divided into the subclasses of remotely operated vehicles (ROVs) and autonomous underwater vehicles (AUVs). Whereas remotely operated vehicles are usually controlled by a connecting cable, autonomous underwater vehicles fulfill a mission without being constantly monitored by a human operator. However, unmanned underwater vehicles and in particular autonomous underwater vehicles are cost effective tools for carrying out a variety of tasks in the underwater environment, e.g. pipeline surveys and inspections or military tasks.

AUVs usually provide a slightly positive buoyancy enabling the AUV to appear mechanically at the surface after accomplishing its mission or in case of any malfunctions, e.g. of the power supply of the AUV. However, a slightly negative buoyancy of the vehicle can be provided, which is advantageous in case of dangerous loads.

The recovery is one of the most critical operations of the entire mission of a submersible vehicle since any damage to the valuable AUV has to be avoided. To prevent the AUV from harms caused by recovery means, e.g. a hook of a crane, a common method for recovering the vehicle provides releasing a recovery buoy, e.g. the nose cone of a hull of the AUV, and recovering the buoy and the AUV one after another. However, the recovery buoy is releasably attached to the vehicle and connected to the vehicle by a recovery line. The ejected recovery buoy is recovered from the surface and brought on board the operation platform, e.g. a surface vessel, where the recovery line is attached to a recovery system by the crew involved. After attaching the recovery line to the recovery system, e.g. a crane, the recovery operation continues with lifting the AUV by means of the recovery system and the recovery line. The preceding step of recovering the buoy permits a successive recovery of the vehicle without grappling the floating vehicle.

U.S. Pat. No. 7,814,856 B1 discloses a system and an apparatus for underwater work activity incorporating a manned submersible vessel and a remotely operated vehicle (ROV) for deep sea bottom work. The system includes a power buoy which is supported, if not being in use, on a buoy support attached between the stern areas of each of two hulls of the primary vessel. The surface power buoy provides an upstanding RF antenna for receiving and transmitting radio frequency communication signals between the manned vessel and other boats and ships in the area as well as land based RF transmitters. For retrieval of the ROV the system further includes an ROV launch cage structured to house and support and to protect the ROV therewithin, which is supported at a lifting ring by the ROV's umbilical cord.

JP 62 234794A shows an unmanned submarine tool with a recovery device to collect submerged objects. A male type anchoring metal is inserted into a hole of the submerged object. By moving the recovery device backwards the anchoring metal is detached and further moving backwards breaks up the whole body of the recovery device for separation. After separation of the recovery device, buoys float while drawing a high tension rope, which enables a working boat to collect the submerged object by pulling up the high tension rope.

EP 1 125 838 A1 discloses an apparatus for gripping and moving a surfaced underwater craft comprising a crane mounted on-board a ship and provided with articulated arms and a crane cable. The crane is connected at its free end to a device for gripping the craft to be recovered, wherein said device comprises a gripping unit mounted on floats and provided with propulsion means to allow movement of the device parallel to the surface and towards the craft to be recovered.

US 2008/0029015 A1 discloses a recoverable optical fiber tethered buoy assembly, wherein the buoy provides an antenna for communication purposes U.S. Pat. No. 5,377,165 discloses a communication system for submarines providing two underwater vehicles lack of them comprising a separable nose cone.

A drawback of the successive recovery of the recovery buoy and the AUV is the possibility of the recovery buoy to float in the near vicinity of the vehicle due to strong currents or wind effects or any other inappropriate weather conditions. Moreover, during the recovery operation the recovery means, e.g. the hook of a crane, can come into a weaving motion due to wind effect or roll or pitch movements of a parent vessel. The weaving recovery means may damage the AUV, if the buoy is floating in the near vicinity of the AUV.

Since an autonomous underwater vehicle loses all contact with the surface after launching, it accomplishes its mission following a program, regularly including a pre-programmed mission time. Thus, autonomous underwater vehicles may return to the surface at times with inappropriate recovery conditions, which were not predictable at the time of launching the vehicle.

However, inappropriate recovery conditions lead to a high risk of damaging the vehicle during an attempt to grapple the buoy, complicating the recovery of the vehicle. Therefore, failure of the recovery attempt or even impossibility of a recovery operation have to be taken into consideration.

In view of the above, it is therefore an object of the present invention to provide an unmanned underwater vehicle and a method for recovering an unmanned underwater vehicle, which provide for safe recovery under most weather conditions.

SUMMARY OF THE INVENTION

The above object generally is achieved according to a first aspect of the invention by providing an unmanned underwater vehicle provided with a recovery buoy releasably attached to the vehicle and adding additional buoyancy to a net-buoyancy of the vehicle, with the recovery buoy being connected to the vehicle by a recovery line. The vehicle itself without the additional buoyancy of the recovery buoy provides negative net-buoyancy.

The above object generally is achieved according to a second aspect of the invention by a method for recovering an unmanned underwater vehicle according to the invention comprising the steps of:

- releasing a recovering buoy and its additional buoyancy from the vehicle, with the recovery buoy being connected to the vehicle by a recovery line,
- recovering the recovery buoy from the surface,
- attaching the recovery line to a recovery system, recovering the vehicle using the recovery system and the recovery line, and submerging the vehicle after releasing the recovery buoy by providing negative net-buoyancy of the vehicle without the additional buoyancy of the recovery buoy.

The antecedent recovery of the recovery buoy before the subsequent recovery of the submersible vehicle is possible without any risk of damaging the vehicle, if the vehicle is submerged after releasing the recovery buoy. Submerging the vehicle after releasing the recovery buoy provides a distance between the vehicle and the recovery buoy, enabling to grapple the recovery buoy without any risk of damaging the vehicle submerged.

For submerging the unmanned underwater vehicle antecedently to the recovery of the recovery buoy, the vehicle itself, i.e. without the additional buoyancy of the attached recovery buoy, provides negative net-buoyancy. However, using the common definition of weight as being equal to the force exerted on an object by gravity, buoyancy is commonly defined as an upward directed force, caused by fluid pressure, that opposes an object's weight. Since buoyancy understood as a force is equal to the gravity force of the displaced liquid, the impact of gravity acceleration in context of buoyancy is neglectable. Whereas net-buoyancy designates the buoyancy of the vehicle itself, i.e. without the additional buoyancy of the recovery buoy, under negative net-buoyancy a net-buoyancy being lower than the antagonized gravity forces taking effect on the vehicle is understood. Negative net-buoyancy causes an object, e.g. an unmanned underwater vehicle, to submerge. Since a floating object provides a buoyancy being larger or at least equal to its weight, i.e. provides a balanced or even positive net-buoyancy. The submerging of the vehicle according to the invention after releasing the recovery buoy takes place by reducing the buoyancy of the vehicle due to the release of the recovery buoy and providing negative net-buoyancy.

In an attached state, i.e. in a state of being releasably attached to the vehicle, the recovery buoy adds additional buoyancy to the net-buoyancy of the vehicle. The release of the recovery buoy and the release of its additional buoyancy reduces the buoyancy of the entire arrangement of the vehicle. After the recovery operation is set in motion the buoyancy of the entire arrangement of the vehicle is reduced by surfacing the ejected recovery buoy, causing the vehicle to submerge. When the recovery buoy surfaces, its additional buoyancy has no longer effect on the buoyancy of the vehicle, leaving the vehicle with its original negative buoyancy without the recovery buoy. Due to the negative net-buoyancy the vehicle disappears from the surface and is out of the vicinity of the buoy, when the recovery buoy is being grappled. In the submerged state the vehicle remains in a safe distance to the recovery buoy enabling a safe recovery of the buoy and subsequently of the vehicle itself under almost any weather condition.

Preferably, the additional buoyancy of the recovery buoy is larger than the magnitude of the negative net-buoyancy of the vehicle itself, thus providing a positive buoyancy of the vehicle in the operation state with the combined buoyancies of the vehicle itself and the recovery buoy. This embodiment enables the vehicle to return to the surface mechanically, which is advantageous in case of lost of control, e.g. in case of lost of power supply or connection to an external control unit as far as remotely operated vehicles are concerned.

In other embodiments of the invention the buoyancy of the vehicle including the buoyant effects of the recovery buoy is slightly negative, wherein the buoyancy needed for maneouvring the vehicle is generated dynamically by the vehicle's propulsion. In case of emergency, e.g. in case of lost of power supply, an approach of the vehicle to the surface is excluded, which is desirable for vehicles with confidential contents or dangerous loads, e.g. ammunition, or other hazardous material on board the vehicle.

However, in embodiments of unmanned underwater vehicles with negative buoyancy including the additional buoyancy, means for generating positive buoyancy in case of initiation of a recovery procedure are provided. In order to generate positive buoyancy on demand the vehicle may comprise a float chamber. Alternatively or additionally ballast may be released simultaneously with the release of the recovery buoy and/or recovery buoys comprising extendable buoyant bodies are provided.

In a preferred embodiment, the additional buoyancy of the recovery buoy is larger than the magnitude of the negative net-buoyancy of the vehicle itself, i.e. without the recovery buoy, in a range of 1% to 20% of said magnitude. Thus, a negative net-buoyancy slightly below the point of balance can be provided, generating a sufficient magnitude of negative net-buoyancy to submerge the vehicle according to the invention on the one hand with as little stress in the recovery line as possible on the other hand since low forces corresponding to the slightly negative net-buoyancy take effect on the vehicle after releasing the recovery buoy.

In an advantageous embodiment of the invention the additional buoyancy of the releasably attached recovery buoy corresponds to a weight of displaced liquid which is about 10 N (corresponding round about to a mass of 1 kg) larger than the weight of displaced liquid corresponding to the negative net-buoyancy taking effect on the vehicle, e.g. at a negative net-buoyancy of the vehicle itself which corresponds to a weight of displaced liquid of 100 N (corresponding round about to a mass of 10 kg) the additional buoyancy of the recovery buoy corresponds to a weight of displaced liquid of about 110 N (corresponding round about to a mass of 11 kg).

Preferably, the recovery line is attachable to a means for crane deployment and recovery, e.g. a hook or an eye for a crane provided on an operation platform like surface vessels. In this embodiment the vehicle can be lifted using the recovery line without any further application steps.

In an advantageous embodiment of the invention the vehicle is provided with two or more recovery buoys, connected to each other by an auxiliary rope. Thus, the additional buoyancy needed to generate positive net-buoyancy is provided by means of two or more recovery buoys. The auxiliary rope extends between two recovery buoys and facilitates the grappling of the buoy-arrangement during the recovery operation.

Providing a plurality of recovery buoys is advantageous in particular in an embodiment of the vehicle with two or more hulls, wherein each of the hulls carries a recovery buoy. Thus, the additional buoyancy of the recovery buoys is provided all over the vehicle, thus providing balanced buoyancy effects on the vehicle during its operation.

Preferably, the recovery buoys comprise a longitudinal shaped body with arched sections applied to a perimeter of the respective hull to provide a compact configuration of the vehicle.

In a preferred embodiment, the hulls are attached to each other by means of cross bars, wherein the recovery buoys are located in a longitudinal space between the cross bars, thus reducing the size of the unmanned underwater vehicle.

Submerging an unmanned underwater vehicle according to the invention is advantageous in particular with regard to autonomous underwater vehicles (AUVs). AUVs fulfill their mission autonomously by means of internal (control) equipment, i.e. without being constantly monitored by a human operator. AUVs are preferably provided with positive net-buoyancy to appear at the surface mechanically after fulfilling the mission and contain valuable equipment for autonomous operation. These valuable vehicles can be recovered according to the invention without the risk of any harm to the vehicle.

Further advantageous embodiments and developments are defined in the dependent claims. These and other aspects of the invention will be apparent from and elucidated with reference to the embodiments as described hereinafter with reference to the accompanying drawings.

DETAILED DESCRIPTION OF THE INVENTION

Figure 1:
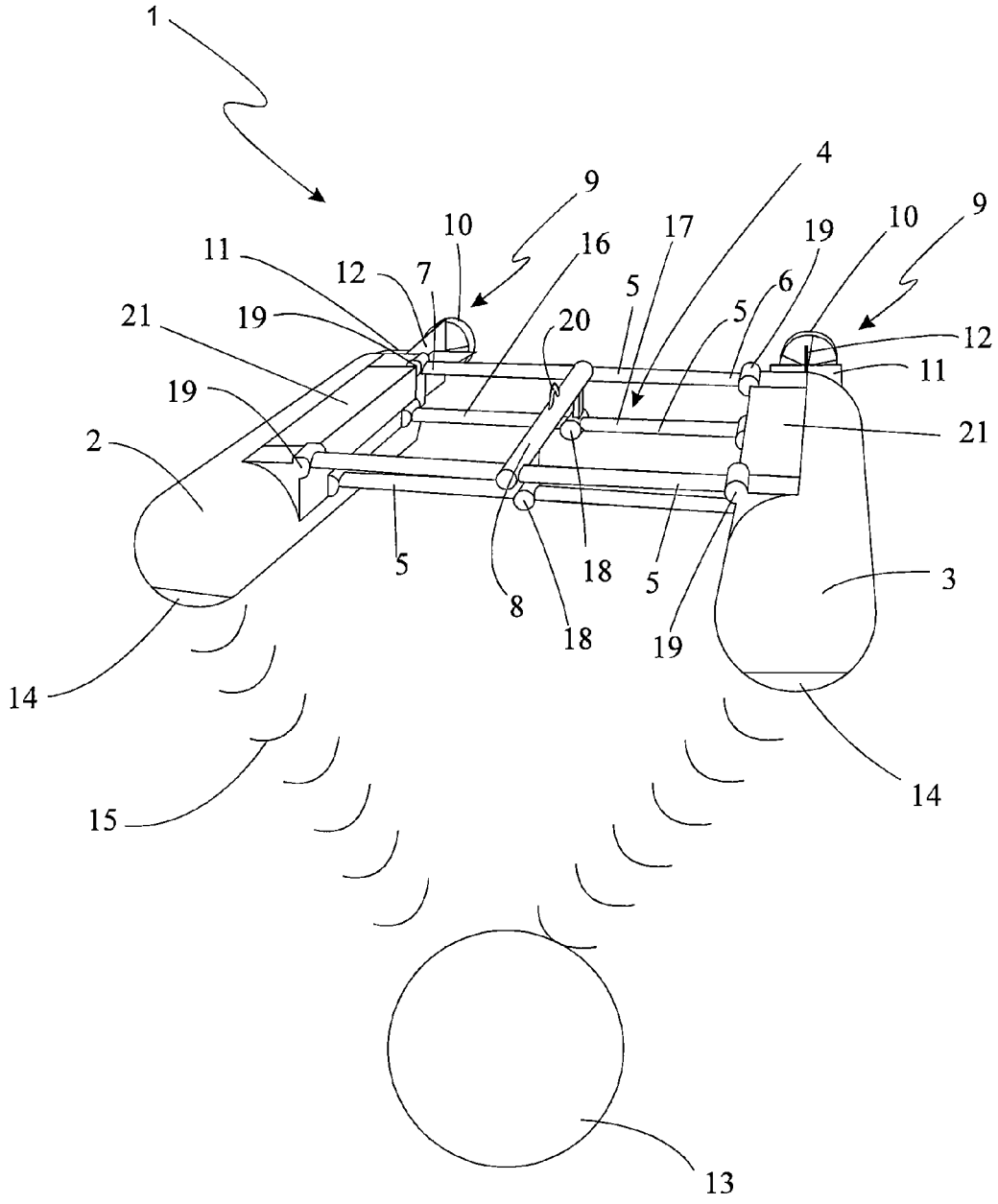
FIG. 1 is a perspective view of an AUV in operation.

In the following description of an advantageous embodiment similar reference numerals are used for similar features.

FIG. 1 depicts an autonomous underwater vehicle (AUV) 1 with two hulls 2, 3 arranged in parallel. The hulls 2, 3 are connected by a framework 4 comprising cross bars 5 attached to the respective hulls 2, 3 at their endings 6, 7, and comprising a longitudinal bar 8 located in parallel to the hulls 2, 3 in the centre of the space between the hulls 2, 3. The hulls 2, 3 are tube-shaped and built as pressure housings containing the electronics, the batteries and systems requirements of the AUV 1, e.g. means for navigation or communication as well as a control unit (not shown). Each hull 2, 3 comprises a propulsion unit 9 comprising a propeller 10, fins 11 and side rudders 12.

The hulls 2, 3 are arranged in distance to each other, i.e. spaced apart from each other, wherein the framework 4 determines the space between the hulls 2, 3. The distance of the hulls 2, 3 provides a large width of the AUV 1, which is advantageous for a plurality of inspection tasks, for example surveying of pipelines 13 or other underwater bodies. Each hull 2, 3 comprises a multibeam sonar 14 to carry out inspection tasks, wherein the sonar signals 15 of the multibeam sonars 14 are coordinated. Due to the distance of the hulls 2, 3 the multibeam sonars 14 are able to send or receive sonar signals 15 in advantageous angles in order to compute improved inspection results.

In the present embodiment of the AUV 1 the framework 4 is foldable, wherein the cross bars 5 comprise two pivotable levers 16, 17 connected by main joints 18, respectively. The main joints 18 are located adjacently to the longitudinal bar 8. Each lever 16, 17 is attached to the respective hull 2, 3 by auxiliary joints 19 to provide smooth running of the foldable framework 4.

Furthermore, the AUV 1 comprises a means for crane deployment and recovery. In the depicted embodiment of the AUV the means for crane deployment and recovery is an eye 20 attached to the longitudinal bar.

Moreover, each hull 2, 3 carries a recovery buoy 21, which is releasably attached to the respective hull 2, 3. The recovery buoys 21 are connected with the AUV 1 by a recovery line 22. The recovery line 22 of both recovery buoys 21 are attached to the longitudinal bar 8, especially to the eye 20 provided on the longitudinal bar. In other embodiments the recovery buoys 21 can be connected to the respective hulls by individual recovery lines.

The recovery buoys 21 are located amidships in the space between the cross bars 5. In the depicted embodiment of the AUV 1 the cross bars 5 are arranged in pairs, wherein the recovery buoys 21 are located in the space between the pairs of the cross bars 5. In other embodiments the recovery buoys 21 can be attached to other section of the AUV. However, a single recovery buoy 21 can be provided or more than two recovery buoys 21 can be provided and arranged at an appropriate place.

The recovery buoys 21 comprise a longitudinal shaped body with arched sections 23 (FIG. 2) applied to the perimeter of the respective hull 2, 3. The shape of the recovery buoys 21 with an arched section 23 provides a compact arrangement of the recovery buoys 21 on the surface of the hulls 2, 3. The recovery buoys 21 comprise a foam material. To release the recovery buoys 21 in order to recover the AUV 1, the recovery buoys 21 are attached to the hulls 2, 3 with a suitable release-mechanism (not shown).

In the operating state, i.e. the state with the recovery buoys 21 attached to the hulls 2, 3, the AUV 1 has positive buoyancy. The positive buoyancy is a sum of the net-buoyancy of the AUV 1 itself and the additional buoyancy provided by the attached recovery buoys 21, opposed by the weight of the entire arrangement, which is lower than the entire buoyancy. Thus, without propulsion, e.g. at the end of a mission or in case of malfunction of power supply, the AUV 1 shows a tendency to emerge. The positive net-buoyancy is provided by the additional buoyancy of the attached recovery buoys 21.

Figure 2:
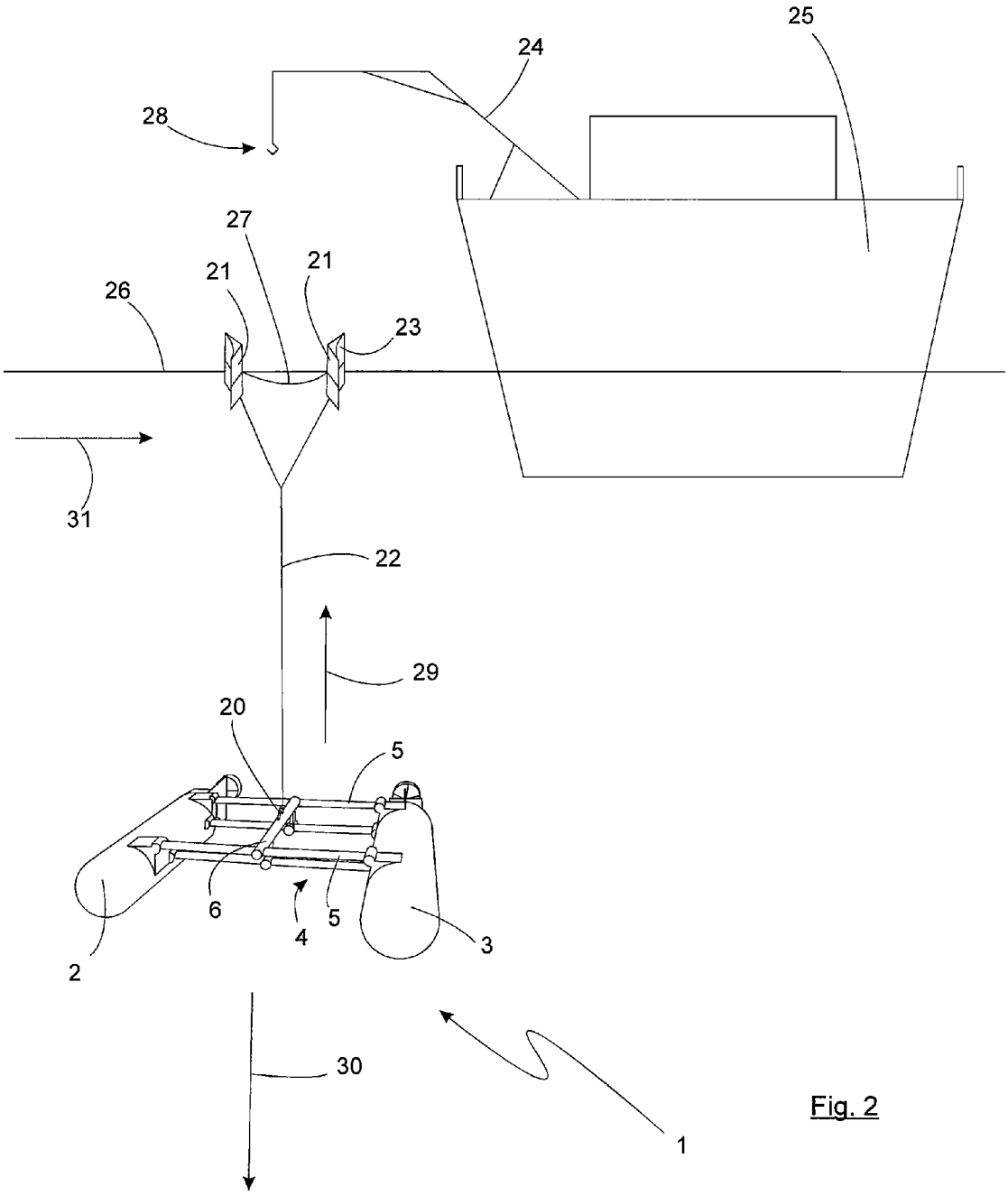
FIG. 2 is a schematic view of an AUV during recovery procedure.

FIG. 2 depicts the recovery of the AUV 1, taking place with the aid of a recovery system mounted on board a buoyant platform, e.g. a surface vessel 25. The recovery system comprises a crane 24. However, in other embodiments the recovery system can comprise any other hoisting device than a crane. FIG. 2 depicts the stern of the vessel 25 with the crane 24 located amidships. In other embodiments the crane 24 can be located at the stern or even the bow of a vessel 25.

To initiate the recovery of the AUV, the recovery buoys 21 are released from the hulls 2, 3. After their release from the hulls 2, 3 the recovery buoys 21 are floating on the surface 26 due to their own buoyancies. In the following step of the recovery operation the recovery buoys 21 including the attached recovery line 22 are recovered. To provide a safe and easy recovery of the recovery buoys 21 the recovery buoys 21 are connected to each other by an auxiliary rope 27. For the recovery of the buoys 21 and the attached recovery line 22 the auxiliary rope 27 has to be grappled by the involved crew of the vessel 25 with the aid of the crane 24 and the crane's hook 28.

To provide a safe recovery of the AUV 1 under almost any weather condition the AUV 1 is being submerged after releasing the recovery buoys 21 by reducing the buoyancy of the AUV 1. The net-buoyancy 29 of the AUV 1 is directed upwards to the surface 26 as depicted in FIG. 2 by the respective arrow designated with reference numeral 29 and corresponds with the weight of the seawater displaced by the AUV 1. The net-buoyancy 29 is the buoyancy of the AUV 1 itself without the additional buoyancy provided by the recovery buoys 21, wherein the additional buoyancy is included in the buoyancy of the entire arrangement in the operating state of the AUV 1 (FIG. 1) with the recovery buoys 21 being attached to the hulls 2, 3.

The weight 30 of the AUV 1 is directed contrawise as indicated in FIG. 2 by the arrow designated with reference numeral 30. The weight 30 of the AUV 1 itself without the released recovery buoys 21 is larger than the net-buoyancy 29, i.e. the weight of the displaced seawater without the recovery buoys 21, generating negative net-buoyancy.

The recovery buoys 21 comprise a foam material and generate additional buoyancy which takes effect on the AUV 1 as long as the recovery buoys 21 are attached to the hulls 2, 3. However, when releasing the recovery buoys 21, the additional buoyancy of the recovery buoys 21 becomes ineffective with reference to the AUV 1, thereby reducing the buoyancy of the AUV 1. Thus, the negative net-buoyancy 29 of the AUV 1 itself causes the AUV 1 to submerge.

An approach of the recovery buoys 21 in the vicinity of the AUV 1 due to the effect of current 31 or any other weather impact is excluded, when the AUV 1 is being submerged during the recovery operation of the buoys 21. In the submerged state the AUV 1 is kept in a safe distance to the recovery buoys 21 excluding any possibility for the hook 28 to come in touch with the AUV 1. Independent from almost any weather condition during the recovery, damaging of the AUV 1 during the antecedent recovery of the buoys 21 can be avoided.

The additional buoyancy of the recovery buoys 21 is larger than the net-buoyancy 29 of the AUV 1 itself, i.e. without the effects of the attached recovery buoys 21. Thus, in the operating state of the AUV depicted in FIG. 1 with the recovery buoys 21 being attached to the hulls 2, 3, the AUV 1 provides positive buoyancy including the additional buoyancy of the recovery buoys 21. In other words the recovery buoys 21 contribute to the entire buoyancy of the AUV in a sufficient amount to provide positive buoyancy in total. However, after release of the recovery buoys 21, the additional buoyancy of the recovery buoys 21 becomes ineffective concerning the AUV 1, thereby reducing the buoyancy of the AUV 1 to submerge the AUV 1.

However, since the additional buoyancy of the recovery buoys 21, even in the state of the recovery buoys 21 floating at the surface 26, is larger than the net-buoyancy 29 of the AUV 1, the AUV 1 is prevented from further sinking by means of the recovery buoys 21 and the recovery line 22. The additional buoyancy of the recovery buoys 21 is larger than the magnitude of the net-buoyancy 29 of the AUV 1 in a range of 1% to 20% of said net-buoyancy 29 to keep the AUV 1 submerged without any substantial stress in the recovery line 22. An additional buoyancy of the recovery buoys 21 corresponding with a weight of displaced seawater of about 1 kg larger than a weight of displaced liquid corresponding to the negative net-buoyancy 29 is regarded as sufficient to keep the AUV 1 submerged in a safe distance to the recovery buoys 21 with as little stress in the recovery line 22 as possible. At a negative net-buoyancy 29 of the AUV 1 corresponding to a weight of displaced liquid of 100 N (corresponding round about to a mass of 10 kg) the additional buoyancy of the recovery buoys 21 may correspond with a weight of displaced seawater of about 110 N (corresponding round about to a mass of 11 kg).

All the feature of an unmanned underwater vehicle or a method for recovering an unmanned underwater vehicle mentioned in description and the claims are to be considered as disclosed individually as well as in any combination of any of these features.

What is claimed is:

1. An unmanned underwater vehicle comprising an autonomous underwater vehicle or a remotely operated underwater vehicle, said unmanned underwater vehicle comprising:

at least one recovery buoy of a solid buoyant material releasably attached to an exterior surface of a hull of the unmanned underwater vehicle, the recovery buoy adding additional buoyancy to a net-buoyancy of the unmanned underwater vehicle during an operating state of the unmanned underwater vehicle where propulsion provides thrust to submerge the unmanned underwater vehicle, wherein the additional buoyancy of the recovery buoy is larger than the magnitude of the negative net-buoyancy of the unmanned underwater vehicle, and a recovery line attached to the recovery buoy and hull for tethering said recovery buoy to the unmanned underwater vehicle after release of the recovery buoy from the exterior surface of the hull during a recovery state of the unmanned underwater vehicle, wherein the unmanned underwater vehicle itself without the additional buoyancy of the recovery buoy secured to the exterior surface of the hull provides negative net-buoyancy so that the unmanned underwater vehicle sinks below and is remote from the recovery buoy.

2. The unmanned underwater vehicle according to claim 1, wherein the additional buoyancy of the recovery buoy is larger than the magnitude of the negative net-buoyancy of the unmanned underwater vehicle itself in a range of 1% to 20% of said magnitude.

3. The unmanned underwater vehicle according to claim 1, wherein the recovery line is attachable to a means for crane deployment and recovery.

4. The unmanned underwater vehicle according to claim 1, wherein said unmanned underwater vehicle includes two or more releasably attached recovery buoys, and wherein the recovery buoys are connected to each other by an auxiliary rope.

5. The unmanned underwater vehicle according to claim 4, wherein the unmanned underwater vehicle comprises two or more hulls, wherein each of the hulls carries one of the recovery buoys.

6. The unmanned underwater vehicle according to claim 5, wherein the recovery buoys comprise a longitudinal shaped body with arched sections applied to a perimeter of its respective hull.

7. The unmanned underwater vehicle according to claim 5, wherein the hulls are attached to each other by means of cross bars, wherein the recovery buoys are located in a longitudinal space between the cross bars.

8. The unmanned underwater vehicle according to claim 1, wherein the unmanned underwater vehicle is an autonomous underwater vehicle.

9. A method for recovering an unmanned underwater vehicle according to claim 1, comprising the following steps:

releasing the releasably attached recovery buoy and its additional buoyancy from the exterior surface of the hull of the unmanned underwater vehicle, wherein said recovery buoy is tethered to the unmanned underwater vehicle by the recovery line so that the unmanned underwater vehicle sinks below and is remote from the recovery buoy after the recovery buoy is released, recovering the recovery buoy from the surface, attaching the recovery line to a recovery system, and after releasing the recovering buoy, recovering the unmanned underwater vehicle by means of the recovery system and the recovery line.

10. The method for recovering an unmanned underwater vehicle according to claim 9, wherein the buoyancy of the unmanned underwater vehicle is negative and releasing the releasably attached recovery buoy causes the unmanned underwater vehicle to sink.

11. The method for recovering an unmanned underwater vehicle according to claim 9, wherein said unmanned underwater vehicle comprises a remotely operated underwater vehicle.

12. The method for recovering an unmanned underwater vehicle according to claim 9, wherein said unmanned underwater vehicle comprises an autonomous underwater vehicle.

13. The method for recovering an unmanned underwater vehicle according to claim 9, wherein said method further comprises submerging said underwater vehicle after releasing said recovery buoy up to a depth corresponding to the length of recovery line.

14. The method for recovering an unmanned underwater vehicle according to claim 9, wherein said method further comprises steering said unmanned underwater vehicle towards the surface before releasing the releasably attached recovery buoy.

15. The unmanned underwater vehicle according to claim 1, wherein said unmanned underwater vehicle comprises a remotely operated underwater vehicle.

* * * * *